US008590447B2

(12) United States Patent
Burke et al.

(10) Patent No.: US 8,590,447 B2
(45) Date of Patent: Nov. 26, 2013

(54) SYSTEM AND METHOD FOR SELF-ADMINISTERING AUTOMATED HAND-MARKINGS

(75) Inventors: Jonathan Burke, Beverly, MA (US); Heather Calvin, Arlington, MA (US); Aileen Duffy, Lawrence, MA (US); Michael Horvath, Andover, MA (US); Kevin McEleney, Medford, MA (US)

(73) Assignee: Museum of Science, Cambridge, MA (US)

( * ) Notice: Subject to any disclaimer, the term of this patent is extended or adjusted under 35 U.S.C. 154(b) by 427 days.

(21) Appl. No.: 12/828,828

(22) Filed: Jul. 1, 2010

(65) Prior Publication Data

US 2011/0048257 A1 Mar. 3, 2011

Related U.S. Application Data

(60) Provisional application No. 61/222,624, filed on Jul. 2, 2009.

(51) Int. Cl.
*B41K 3/00* (2006.01)
*B41K 3/66* (2006.01)
*B41F 17/34* (2006.01)

(52) U.S. Cl.
USPC ..... 101/41; 101/35

(58) Field of Classification Search
USPC ..... 101/327, 41, 42, 104, 105, 106, 107, 101/108, 112, 109–111, 334, 4, 406, 371, 101/56, 333, 405, 379, 43, 233, 134.5, 68, 101/103; 100/52, 51, 347; 427/1; 118/31.5
IPC ..... B41K 3/00,3/02, 3/66, 3/64; B41F 17/30, B41F 17/36
See application file for complete search history.

(56) References Cited

U.S. PATENT DOCUMENTS

| | | | | | |
|---|---|---|---|---|---|
| 2,701,520 | A | * | 2/1955 | Rider | 101/41 |
| 3,094,920 | A | * | 6/1963 | Priesmeyer | 101/41 |
| 4,038,922 | A | * | 8/1977 | McGregor | 101/232 |
| 5,048,414 | A | * | 9/1991 | Hoshino | 101/93.18 |
| 6,162,486 | A | * | 12/2000 | Samouilhan et al. | 427/1 |
| 6,467,404 | B1 | * | 10/2002 | Griffin et al. | 101/21 |
| 2002/0014237 | A1 | * | 2/2002 | Richey et al. | 128/203.25 |
| 2007/0175343 | A1 | * | 8/2007 | Prince | 101/123 |
| 2009/0255422 | A1 | * | 10/2009 | Isler | 101/41 |

FOREIGN PATENT DOCUMENTS

| | | | |
|---|---|---|---|
| JP | 61177249 | * | 8/1986 |
| JP | 11090811 | * | 4/1999 |
| WO | WO 2007062539 | * | 6/2007 |

* cited by examiner

*Primary Examiner* — Daniel J Colilla
*Assistant Examiner* — Ruben Parco, Jr.
(74) *Attorney, Agent, or Firm* — Wilmer Cutler Pickering Hale & Dorr LLP

(57) ABSTRACT

Automated marking devices for self-administering hand markings and methods of use are provided. A device for self-administering hand markings includes a housing, a stamp driving assembly, a stamp assembly, and a planar surface for receiving a patron's hand. The stamp assembly is configured to substantially leave a full stamp impression on the patron's hand, regardless of varying topologies, sizes, and orientations of hands that are placed in the hand marking device.

10 Claims, 6 Drawing Sheets

SYSTEM AND METHOD FOR SELF-ADMINISTERING AUTOMATED HAND-MARKINGS

CROSS-REFERENCE TO RELATED APPLICATION

This application claims priority under 35 U.S.C. §119(e) to U.S. Provisional Application Ser. No. 61/222,624, filed on Jul. 2, 2009, which is hereby incorporated by reference herein in its entirety.

FIELD OF THE INVENTION

The present invention relates to systems and methods for placing an identifying mark on patrons of a venue to indicate that they are authorized entrants. More specifically, the system and method of the present invention are for marking patrons' hands to indicate that they are authorized entrants.

BACKGROUND OF THE INVENTION

In venues such as museums, nightclubs, and fairs, patrons must perform or satisfy certain requirements before being granted entrance, such as paying an entrance fee or verifying their age. If the patron performs the necessary tasks and satisfies these requirements, a venue employee will mark the patron's hand, typically with a pen, marker or stamp to indicate that the patron is an authorized entrant.

Among other things, marking a patron's hand as described allows the patron to leave the venue and return by simply displaying the marking indicating that s/he is an authorized entrant instead of having to demonstrate that s/he has performed the entrance tasks or requirements. However, this marking technique has certain limitations.

Using this conventional marking technique, a venue must employ someone to mark each patron's hand as s/he enters or exits the venue. Often, there is only one venue employee present to perform hand markings. Consequently, during peak business or visiting hours, large lines of patrons can form as they wait to have their hands marked. Further, if the venue employee responsible for marking patrons' hands is stationed at the entrance of the venue, a large line of patrons could form outside and deter other possible patrons from visiting the venue. If the venue employee is stationed at the exit of the venue, a large line of patrons could form inside making it uncomfortable for everyone inside the venue. Furthermore, a patron may choose to leave the venue and not return in order to avoid the crowd of patrons waiting to have their hands marked.

Thus, there is a need for a system and method that will allow a venue to quickly mark a patron's hand upon entering or exiting the venue so that large crowds can be effectively and efficiently processed without detrimentally affecting the visitor experience.

SUMMARY OF THE INVENTION

A system and method for self-administering automated hand-markings is provided. The system of the present invention includes a pneumatic hand stamper that allows patrons to self-mark their hands in an efficient manner and without any assistance from venue employees. According to the system of the present invention, when a patron places his/her hand onto a hand stamper pressure plate, it will cause the pressure plate to activate a snap action switch, which in turn powers an air solenoid through a relay. The air solenoid prompts an air supply to rapidly fill a buffer tank, causing an air cylinder to drive a stamp assembly downward until the stamp comes into contact with the patron's hand. After the stamp contacts the hand under predetermined, controlled pressure for properly stamping the patron's hand, a pressure switch opens and unlatches the relay to stop the power being supplied to the air solenoid. The stamp assembly then moves away from the patron's hand and back to its starting position. Once the patron removes his or her hand from the pressure plate, the snap action switch closes the circuit and the relay is energized and latched for the next patron.

Further, the system of the present invention includes a timer that overrides the pressure switch and unlatches the relay if the pressure switch does not open after a predetermined period of time has elapsed.

Yet further, the system of the present invention includes a counter that monitors the usage of components in the hand marking device.

The hand marking device of the present invention also may be configured to leave substantially a full stamp impression on a patron's hand regardless of the different topologies, sizes, and orientations of patrons' hands that are placed into the hand stamper system for marking.

The present invention will be described in greater detail in the remainder of the specification and claims, referring to the drawings.

DETAILED DESCRIPTION OF THE INVENTION

The present invention is a system and method for self-administering automated hand-markings at a venue to efficiently process both large and small groups of patrons into and out of the venue. In the preferred embodiment of the invention, the hand marking device includes a pneumatic hand stamper that is configured to provide flexibility in its ability to properly stamp various sizes, topologies, and orientations of patrons' hands.

Figure 1:
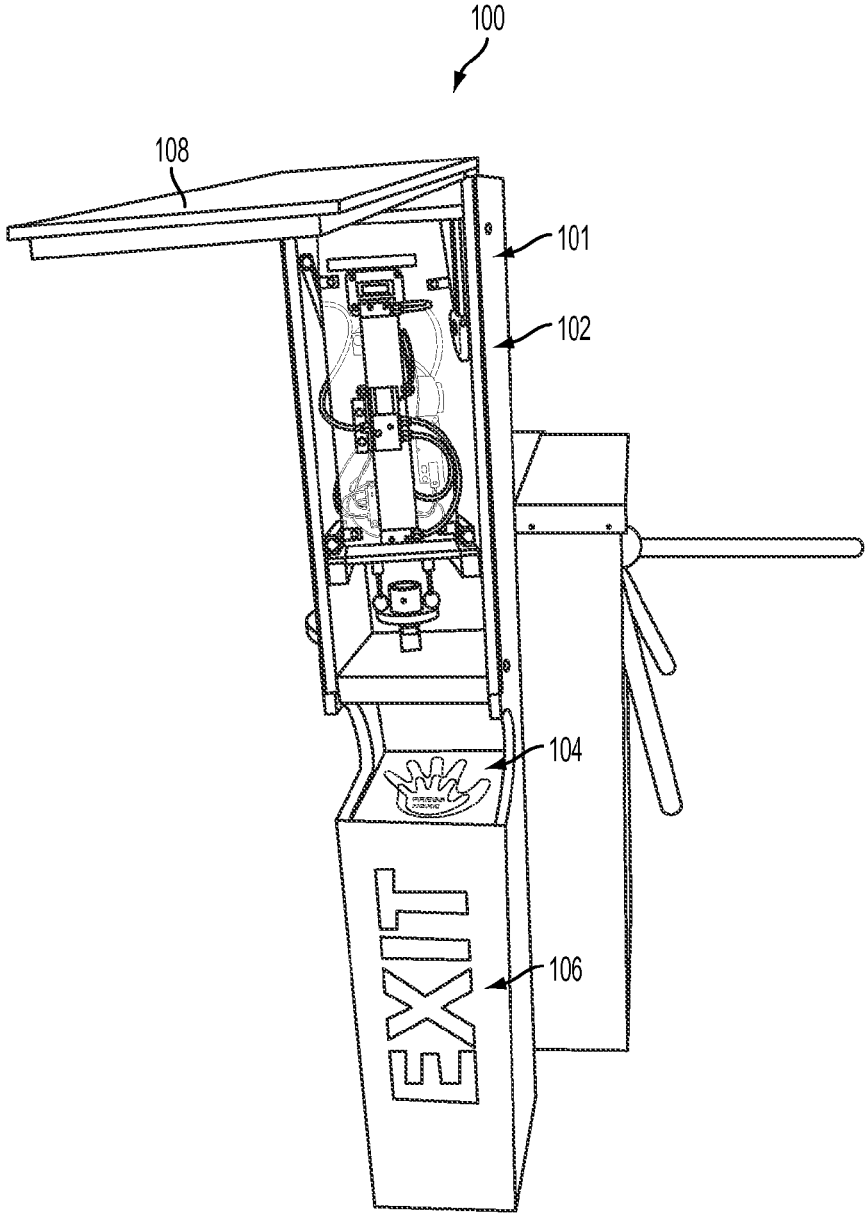
FIG. 1 shows a perspective view of an illustrative hand stamper according to the present invention with the front panel of the upper section open.

Referring to FIG. 1, generally at 100, an embodiment of the present invention is shown. FIG. 1 shows front panel 108 of upper section 102 open, exposing the upper section 102 of housing 101 and the interior portions housed within. As shown, housing 101 includes upper section 102, middle section 104, lower section 106, and movable front panel 108.

Besides front panel 108, other panels associated with housing 101 may be movable or removable to allow access to housing 101 for purposes such as performing maintenance and service.

Figure 2:
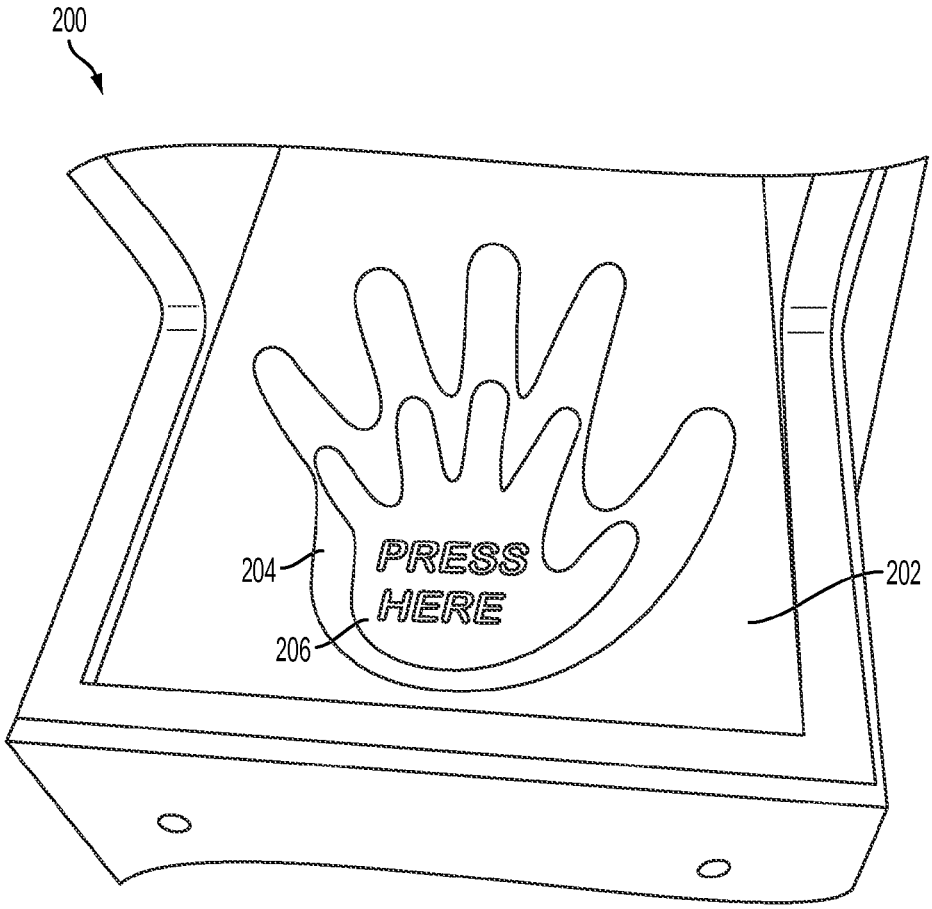
FIG. 2 shows a perspective view of an illustrative hand stamper plate in the middle section of the hand stamper shown in FIG. 1.

Referring to FIG. 2, generally at 200, a detailed view of middle section 104 of housing 101 is shown. As shown in FIG. 2, middle section 104 includes pressure plate 202 and concentric markings 204, 206. Concentric markings 204, 206 identify where the patron should place his/her hand and indicate proper placement for hands of varying sizes, for example, adult hands according to 204 and children's hands according to 206. Concentric markings 204, 206 on pressure plate 202 are preferably coated with antimicrobial coating (not shown) to inhibit bacterial growth. Pressure plate 202 is preferably magnetic so that it can be easily removed and replaced with a magnet.

Figure 3:
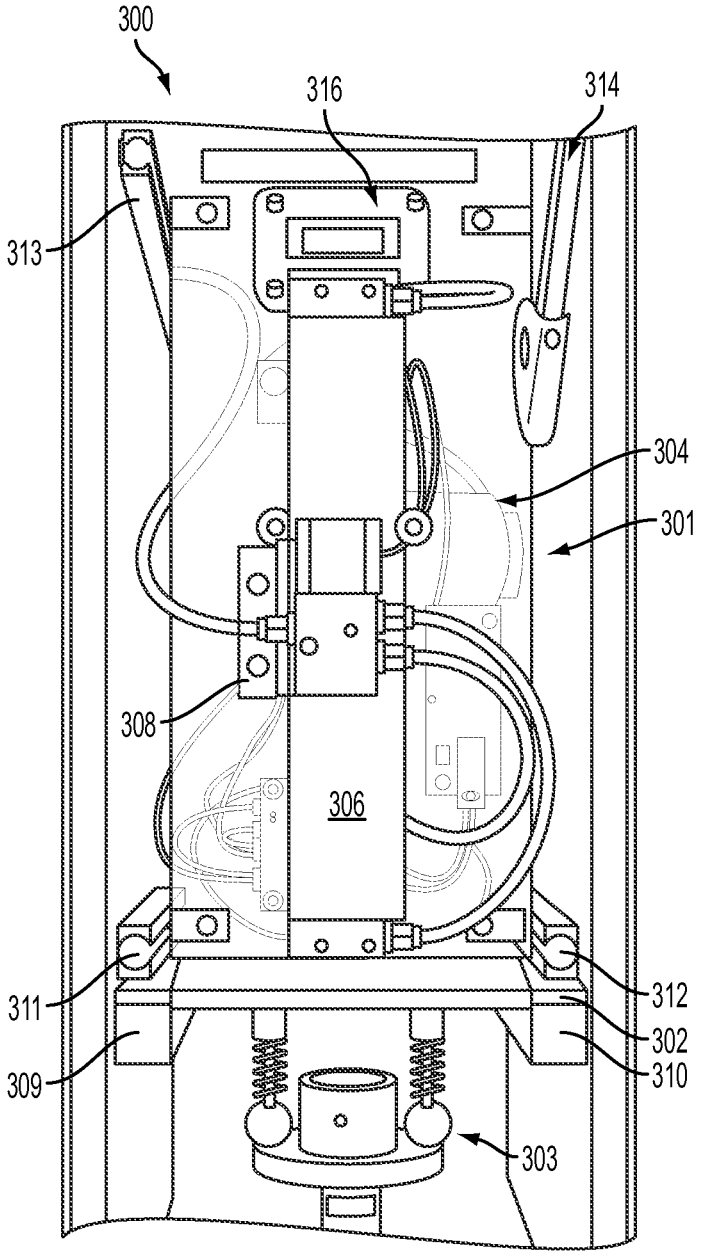
FIG. 3 shows a perspective view of an illustrative upper section of the hand stamper shown in FIG. 1 with the front panel of the upper section open, exposing a front view of the central partition.
Figure 4:
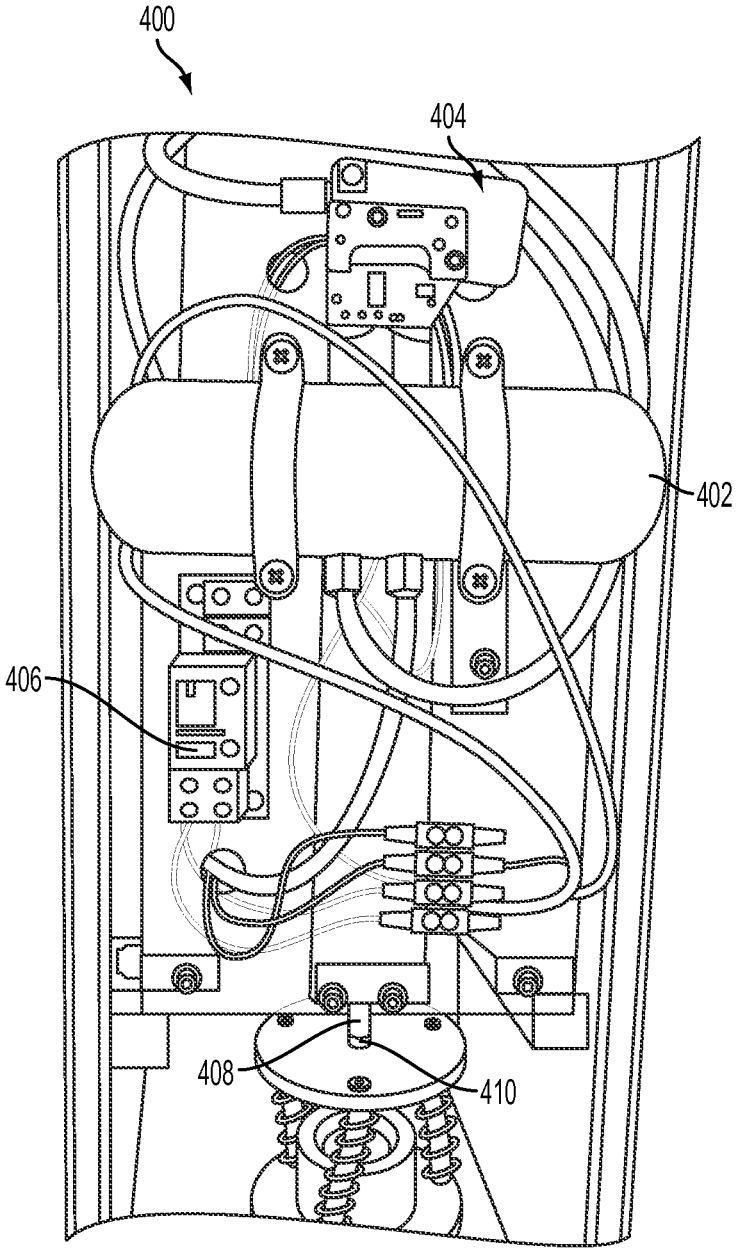
FIG. 4 shows a perspective view of an illustrative upper section of the hand stamper shown in FIG. 1 with the front panel of the upper section open, exposing a back view of the central partition.

Referring to FIG. 3, generally at 300, and FIG. 4, generally at 400, detailed views of upper section 102 of housing 101 with front panel 108 open are shown. More specifically, FIG. 3 shows a front view of central assembly 301 and FIG. 4 shows a back view of central assembly 301.

As shown in FIGS. 3-4, upper section 102 includes central assembly 301, platform 302, and hand stamper assembly 303. In the preferred embodiment, central assembly 301 includes air cylinder 306, air solenoid 308, counter 316, buffer tank 402, pressure switch 404, and relay 406, all of which are attached to partition 304.

Air cylinder 306 is preferably a double acting cylinder with appropriate stroke length to push stamp assembly 303 down to pressure plate 202 (FIG. 2), and pull stamp assembly 303 back up into upper section 102 of housing 101. Air cylinder 306 also preferably is non-rotating in order to properly orient hand stamper assembly 303 with the patron's hand.

Air solenoid 308 is preferably a 12 volt solenoid that includes both a manual test button to test air cylinder 206 and a four-way ported valve with speed control to control the speed of air cylinder 206.

Counter 316 preferably includes a numerical display that increases one digit for every 12 volt signal it receives. Counter 316 also preferably can be reset after a particular event, such as the replacement of a component.

Buffer tank 402 is preferably a commercially available Bimba model pvc storage tank that prevents pressure switch 404 from being falsely triggered when air is ported into buffer tank 402.

Pressure switch 404 is preferably adjustable between a wide range of pressure values so that the pressure with which stamp 612 (FIG. 6) contacts the patron's hand can be changed. In the preferred embodiment, pressure switch 404 is adjustable between 8-10 psi.

Relay 406 is preferably a 12 volt double pole double throw relay that is configured to facilitate troubleshooting by using indicators showing mechanical and electrical functions.

In the preferred embodiment, central assembly 301 is slidably mounted onto the side walls of upper section 102. Specifically, tracks 311, 312, 313, and 314 are mounted onto the side walls of upper section 102, and partition 304 is slidably coupled to tracks 311, 312, 313, and 314. This configuration allows partition 304, and in turn central assembly 301, to move back and forth along tracks 311, 312, 313, and 314.

Platform 302 is mounted below central assembly 301 onto supports 309, 310, and preferably spans the width and depth of upper section 102 to prevent patrons from reaching into housing 101 and accessing central assembly 301.

Hand stamper assembly 303 is coupled to the bottom of air cylinder 306 by threaded rod 408, which can accept a variety of stamp assemblies, and is secured to threaded rod 408 with locking nut 410. The position of hand stamper assembly 303 can be adjusted by sliding central assembly 301 along tracks 311, 312, 313, and 314 as described above.

Figure 5:
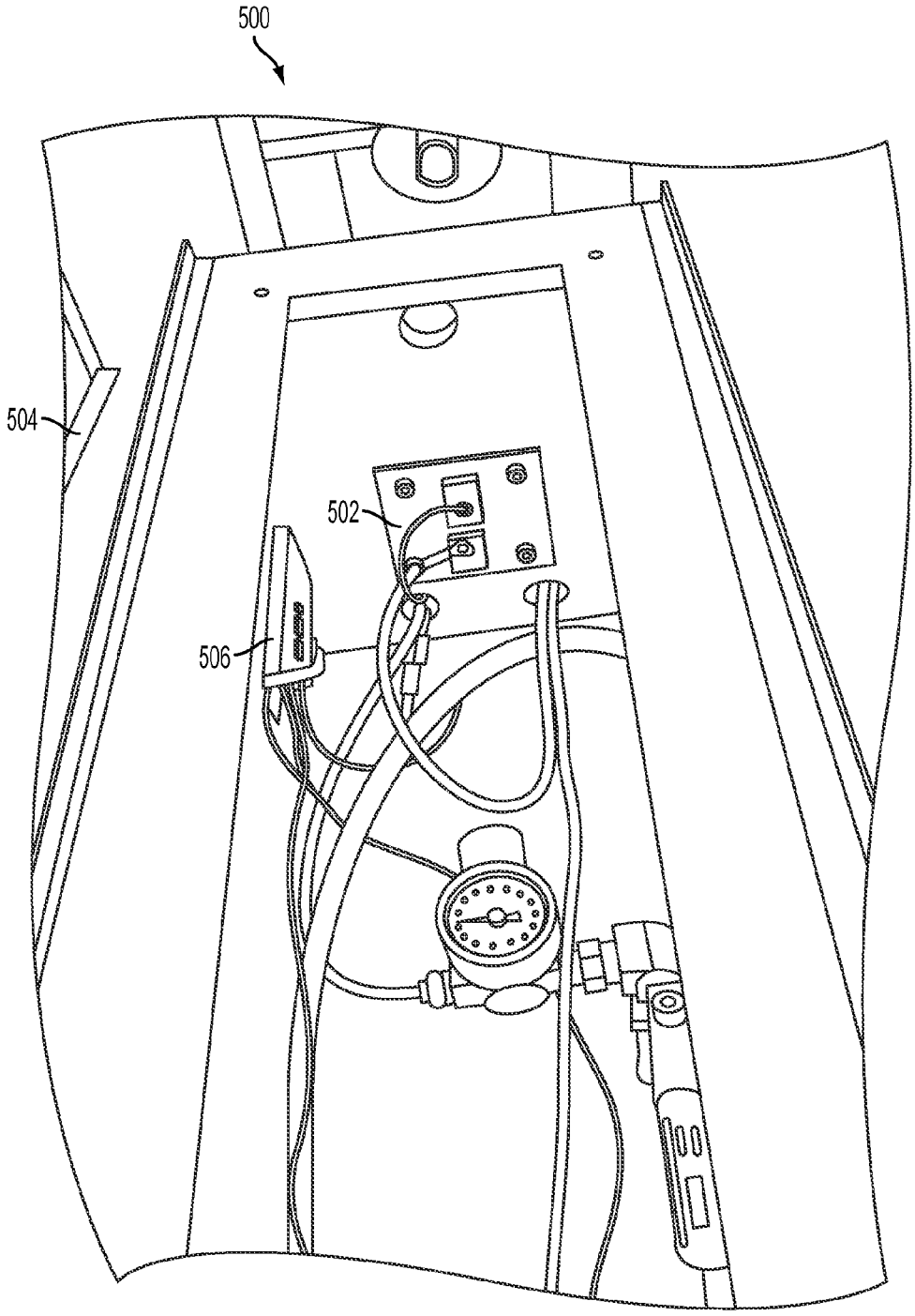
FIG. 5 shows a perspective view of an illustrative lower section of the hand stamper shown in FIG. 1 with the front panel of the lower section removed.

Referring to FIG. 5, generally at 500, a detailed view of lower section 106 of housing 101 is shown. As shown in FIG. 5, front panel 504 of lower section 106 has been removed, exposing lower section 106 of housing 101 and the interior portions housed within. Lower section 106 includes snap action switch 502, timer 506, and an air supply (not shown).

Pressure plate 202 (FIG. 2) is supported by the upper surface of lower section 106 and snap action switch 502 is adjustably coupled to the underside of the upper surface of lower section 106. The distance between snap action switch 502 and pressure plate 202 is adjustable to vary the amount of pressure required to activate snap action switch 502. Snap action switch 502 is preferably a roller switch that can be easily adjusted to minimize lifting of pressure plate 202. In the preferred embodiment, the force needed to actuate snap action switch 502 is minimal, but is slightly greater than the weight of pressure plate 202 to prevent false triggering of snap action switch 502.

Timer circuit 506 is preferably a 12 volt timer that provides an output through a double pole single throw relay and is configured to start timing after a momentary input. Timer 506 is also preferably adjustable to vary the amount of time that hand stamper assembly 303 remains in contact with the patron's hand before timer 506 overrides pressure switch 404.

The air supply preferably provides air at a pressure of at least 30 psi through a hose with at least a ¼ inch diameter. It is understood that the air supply may be from an external source or an air cylinder container within the hand stamper device. In some embodiments where hoses have diameters smaller than ¼ inch, the air supply preferably provides air at a pressure greater than 30 psi. In the preferred embodiment, hand stamper 100 includes a regulator (not shown) that can be controlled to lower the pressure of air coming from the air supply to a pressure that can be used by hand stamper 100. In one example, the regulator lowers the air pressure to 12-13 psi.

When the hand stamper apparatus is in use, it is in communication with a continuously powered air supply (not shown) and power supply (not shown). In the preferred embodiment of the invention, a patron engages the hand stamper by placing his/her hand onto one of at least two concentric markings 204, 206 on the surface of pressure plate 202. This causes pressure plate 202 to activate snap action switch 502, which delivers power to air solenoid 308 through relay 406. When air solenoid 308 is powered, the air supply (not shown) ports air into buffer tank 402 and air cylinder 306. As the air pressure increases, air cylinder 306 causes a piston to drive stamp assembly 303 downward until stamp 612 makes contact with the patron's hand. Stamp 612 remains in contact with the patron's hand until the air pressure in buffer tank 402 reaches a specific level. Once that level is reached, pressure switch 404 opens and unlatches relay 406, stopping power being supplied to air solenoid 308. If pressure switch 404 does not open within a predetermined time period, timer 506 overrides pressure switch 404 and unlatches relay 406 to prevent stamp assembly 303 from freezing in the down position on the patron's hand. Once relay 406 is unlatched, the air in buffer tank 402 is ported into air cylinder 306, driving stamp assembly 303 away from the patron's hand and back to its starting position. After the patron has removed his/her hand from pressure plate 202, snap action switch 502 closes the circuit and relay 406 is energized and latched for the next patron. While the hand stamper apparatus is in use, counter 316 monitors the wear and tear of various components in order to conduct preventative maintenance. In one example, counter 316 monitors the usage of stamp 612 in hand stamper assembly 303.

Figure 6:
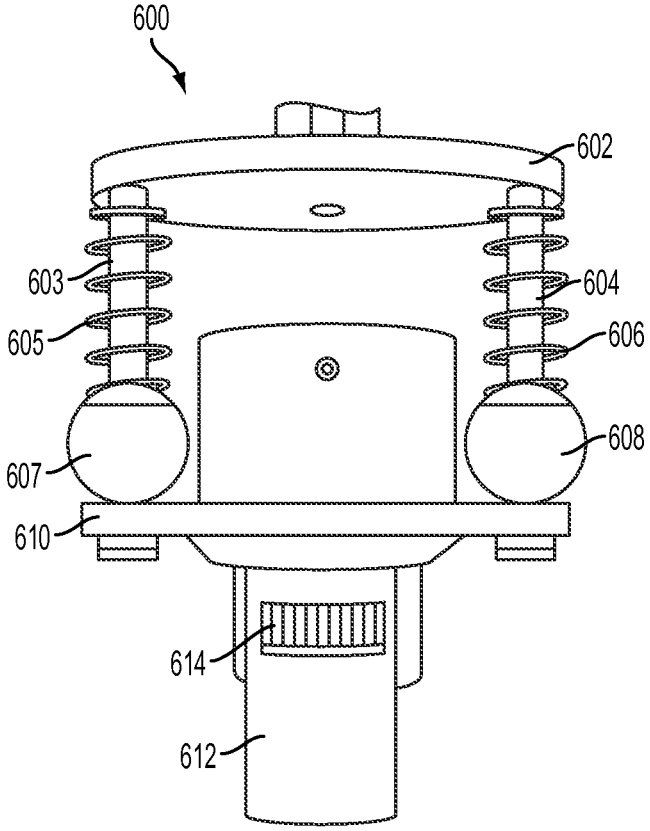
FIG. 6 shows a perspective view of an illustrative hand stamper assembly in the upper section of the hand stamper shown in FIG. 1 in accordance with the preferred embodiment of the present invention.

Referring to FIG. 6, generally at 600, the preferred embodiment of hand stamper assembly 303 is shown. In FIG. 6, hand stamper assembly 303 includes base plate 602, stamp holder plate 610, and stamp 612. The top side of base plate 602 is coupled to air cylinder 306 via threaded rod 408 (FIG. 4). The bottom side of base plate 602 is coupled to stamp holder plate 610 via shoulder bolts 603, 604 and delrin spheres 607, 608. Shoulder bolts 603, 604 are used to control torquing of stamp assembly 303 when it comes into contact with a patron's hand. Shoulder bolts 603, 604 also serve as center shafts for conical compression springs 605, 606, which maintain pressure between base plate 602 and stamp holder plate 610. Delrin spheres 607, 608 allow stamp holder plate 610 to pivot and adjust through different angles in order to stamp different topologies, sizes, and orientations of patrons' hands. Stamp holder plate 610 is preferably machined to limit the depth to which stamp 612 can be inserted. This allows a technician to remove inking tray 614 from the bottom of stamp 612 without having to disassemble stamp assembly 303.

The embodiments of the hand marking device disclosed herein are not limited to marking hands and can be used to mark other objects of various sizes, shapes, topologies, orientations, and materials.

The device disclosed herein is not limited to using a pneumatic assembly and can use alternative systems, such as a hydraulic assembly, for driving the hand stamping assembly.

It will be understood that the foregoing is only illustrative of the principles of the invention, and that various modifications can be made by those skilled in the art without departing from the scope and spirit of the invention.

What is claimed is:

1. An automated marking device for self-administering hand markings, the marking device comprising:

a housing defining a first chamber, a second chamber, and a recess defined by an open area between the first and second chambers;

a stamp driving assembly disposed within the first chamber of the housing;

a stamp assembly coupled to the stamp driving assembly, the stamp assembly configured to substantially provide a full stamp impression on a patron's hand when activated by the stamp driving assembly with the stamp assembly further including a base plate coupled to the stamp driving assembly, a stamp holder plate coupled to the base plate by a coupling mechanism, a stamp removably positioned within the stamp holder plate, and an inking tray disposed within the stamp, the coupling mechanism having: at least one sphere coupled to the stamp holder plate, at least one bolt having a proximal end and a distal end, where the proximal end includes being coupled to the base plate and the distal end includes being disposed through the at least one sphere and the stamp holder plate, and at least one compression spring being concentrically disposed on the outer surface of the at least one bolt, and with the coupling mechanism being configured to allow the bottom of the stamp to stop after the bottom of the stamp comes into contact with a patron's hand under the compression caused by the at least one compression spring while the base plate continues to drive downward and the distal end of the at least one bolt is driven through the stamp holder plate so that the stamp holder plate adjusts its position so the stamp will leave a full stamp impression on the patron's hand regardless of varying topical characteristics of the hand placed into the automated marking device;

a planar surface disposed within the recess of the housing, the planar surface configured to receive the patron's hand, with the planar surface coupled to a switch in electrical communication with the stamp driving assembly such that pressure in at least a first direction by placement of the patron's hand on the planar surface will activate the stamp driving assembly; and a fluid supply disposed within the second chamber of the housing, the fluid supply in fluid communication with the stamp driving assembly for driving the stamp assembly when activated by the placement of the patron's hand on the planar surface and moving the planar surface in at least the first direction.

2. The device of claim 1, wherein the varying topical characteristics include at least one of topology, size, and orientation.

3. The device of claim 1, wherein the stamp driving assembly is a pneumatic-based assembly.

4. The device of claim 1, wherein the stamp driving assembly is a hydraulic-based assembly.

5. The device of claim 1, wherein the planar surface comprises a pressure plate, with the pressure plate including being configured to actuate the stamp driving assembly by the patron's hand moving the pressure plate in at least the first direction.

6. The device of claim 1, wherein the stamp driving assembly further comprises:

a buffer tank in fluid communication with the fluid supply; and a fluid cylinder coupled to the stamp assembly and in fluid communication with the buffer tank, with the fluid cylinder including being configured to use pressurized fluid received from the buffer tank to drive the stamp assembly.

7. The device of claim 6, wherein the stamp driving assembly further includes a pressure switch, with the pressure switch including being configured to stop fluid flow from the fluid supply after the stamp assembly has contacted the patron's hand and a predetermined pressure level has been reached in the buffer tank.

8. The device of claim 1, further including a timer, with the timer including being configured to stop fluid flow from the fluid supply after the stamp assembly has contacted the patron's hand and a predetermined time period has elapsed.

9. The device of claim 1, wherein the device further includes a counter configured to monitor usage of a component in the marking device.

10. The device of claim 1, wherein the device further includes a counter configured to monitor usage of a component in the stamp assembly.

* * * * *